United States Patent [19]

Trautwein et al.

[11] Patent Number: 4,735,362

[45] Date of Patent: Apr. 5, 1988

[54] APPARATUS FOR DELIVERING A LIQUID OR THICK MEDIUM

[75] Inventors: Wolfgang Trautwein, Meersburg; Klaus Zerweck, Leonberg; Peter Konhäuser, Stuttgart; Jürgen Sprenger, Leinfelden-Echterdingen; Heinrich Griebel, Friedrichshafen, all of Fed. Rep. of Germany

[73] Assignees: Wagner Finish Tech Center GmbH, Fed. Rep. of Germany; Wagner International AG, Switzerland

[21] Appl. No.: 897,301

[22] Filed: Aug. 8, 1986

[30] Foreign Application Priority Data

Aug. 21, 1985 [DE] Fed. Rep. of Germany ..... 3529909

[51] Int. Cl.[4] ..... B05B 7/32; B05B 12/00; B05B 9/03

[52] U.S. Cl. ..... 239/127; 239/332; 239/492; 239/493; 239/533.1

[58] Field of Search ..... 239/453, 533.1, 332, 239/127, 464, 492, 493

[56] References Cited

U.S. PATENT DOCUMENTS

| | | | |
|---|---|---|---|
| 2,013,639 | 9/1935 | Steinhart et al. | 239/332 |
| 2,370,155 | 2/1945 | French | 239/493 X |
| 3,095,153 | 6/1963 | Soth | 239/464 X |
| 3,116,879 | 1/1964 | Wagner | 239/332 |
| 3,348,520 | 10/1967 | Lockwood | 239/332 X |
| 3,893,627 | 7/1975 | Siczek et al. | 239/332 |
| 4,189,098 | 2/1980 | Wagner et al. | 239/332 X |
| 4,243,159 | 1/1981 | Spatz . | |

FOREIGN PATENT DOCUMENTS

| | | |
|---|---|---|
| 1163565 | 2/1964 | Fed. Rep. of Germany . |
| 3412628 | 10/1985 | Fed. Rep. of Germany . |
| 1433392 | 6/1966 | France . |

*Primary Examiner*—Andres Kashnikow

*Attorney, Agent, or Firm*—Hill, Van Santen, Steadman & Simpson

[57] ABSTRACT

This invention relates to an apparatus for quantitatively definite delivery of a liquid or thick, pressurized medium such as paint, varnish, glue or the like wherein the medium is placed under pressure by a conveying pump comprising a pump discharge valve and whereby a second valve is provided at or close to the delivery nozzle, this second valve being actuatable by the pressure of the medium to be delivered and having an opening pressure which is greater than that of the pump discharge valve.

3 Claims, 9 Drawing Sheets

FIG. 2
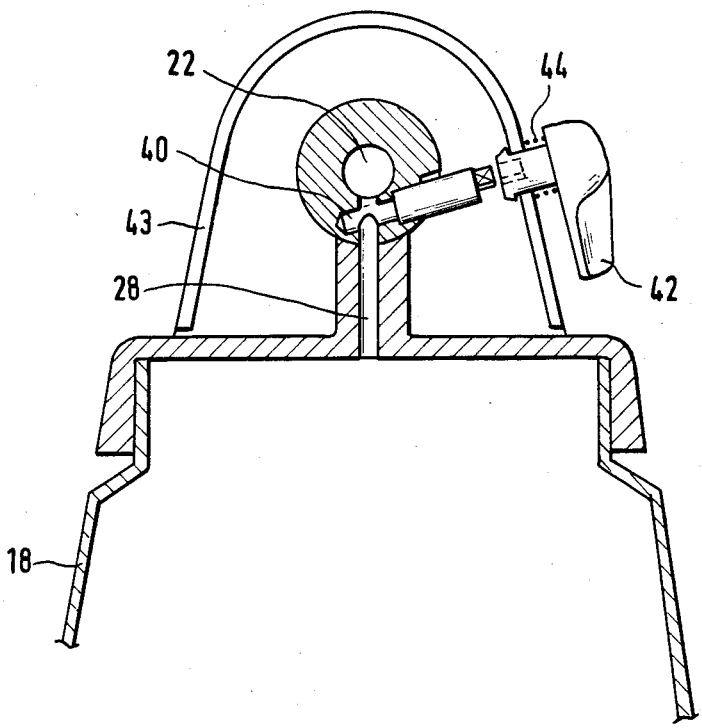
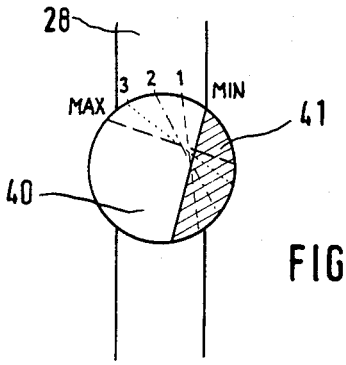
FIG. 2A

APPARATUS FOR DELIVERING A LIQUID OR THICK MEDIUM

BACKGROUND OF THE INVENTION

The invention relates to an apparatus for quantitatively definite delivery of a fluid or thick, pressurized medium such as paint, varnish, glue or the like.

Great numbers of such devices are commercially available, for example, hand-held spray guns having a built-in electrical swinging armature drive and an attached paint reservoir. All of these known devices are activated by activating the pump drive, whereupon the pump begins to operate and the liquid or thick medium is conveyed under pressure to the delivery nozzle. The pump drive is then switched off in order to end the work process. A significant disadvantage in such a system is that the pressure, especially the spraying pressure required for a faultless delivery of the medium, is not present when work is begun, but is only built up after a few strokes of the pump mechanism, the result being that the nebulization or atomization is unsatisfactory at the beginning of the spraying phase, for example, when spraying paint. The same thing occurs when the work process is ended, i.e., a so-called "after-drip" occurs. Further, all of the known devices share the disadvantage that the throughput quantity of the medium to be delivered can be varied per time unit only within a comparatively small range because of adjustment of the pump stroke is only possible to a limited extent.

It is therefore an object of the present invention to improve spray guns of the type initially cited, such that delivery of the medium occurs only when the required delivery pressure is reached and such that the throughput quantity can be varied over a relatively broad range in a simple way.

These and other objects of this invention will become apparent from the following disclosure and appended claims.

SUMMARY OF THE INVENTION

In the invention a second valve is provided so that the discharge nozzle opens only when the required delivery pressure is present in the conveying chamber and the discharge nozzle immediately closes again when the delivery pressure falls below the required pressure. The value of the opening pressure of the second valve thereby defines the quantity of medium delivered per time unit, and the delivered quantity thus can be varied within wide limits in a simple way by adjusting the opening pressure.

BRIEF DESCRIPTION OF THE DRAWINGS

The invention is set forth below with reference to the drawings. Shown therein are:

FIGS. 2 and 2A are partial sectional views, showing in an enlarged scale, a modified embodiment of an overflow and throttle opening shown in FIG. 1;

DESCRIPTION OF THE PREFERRED EMBODIMENT

Figure 1:
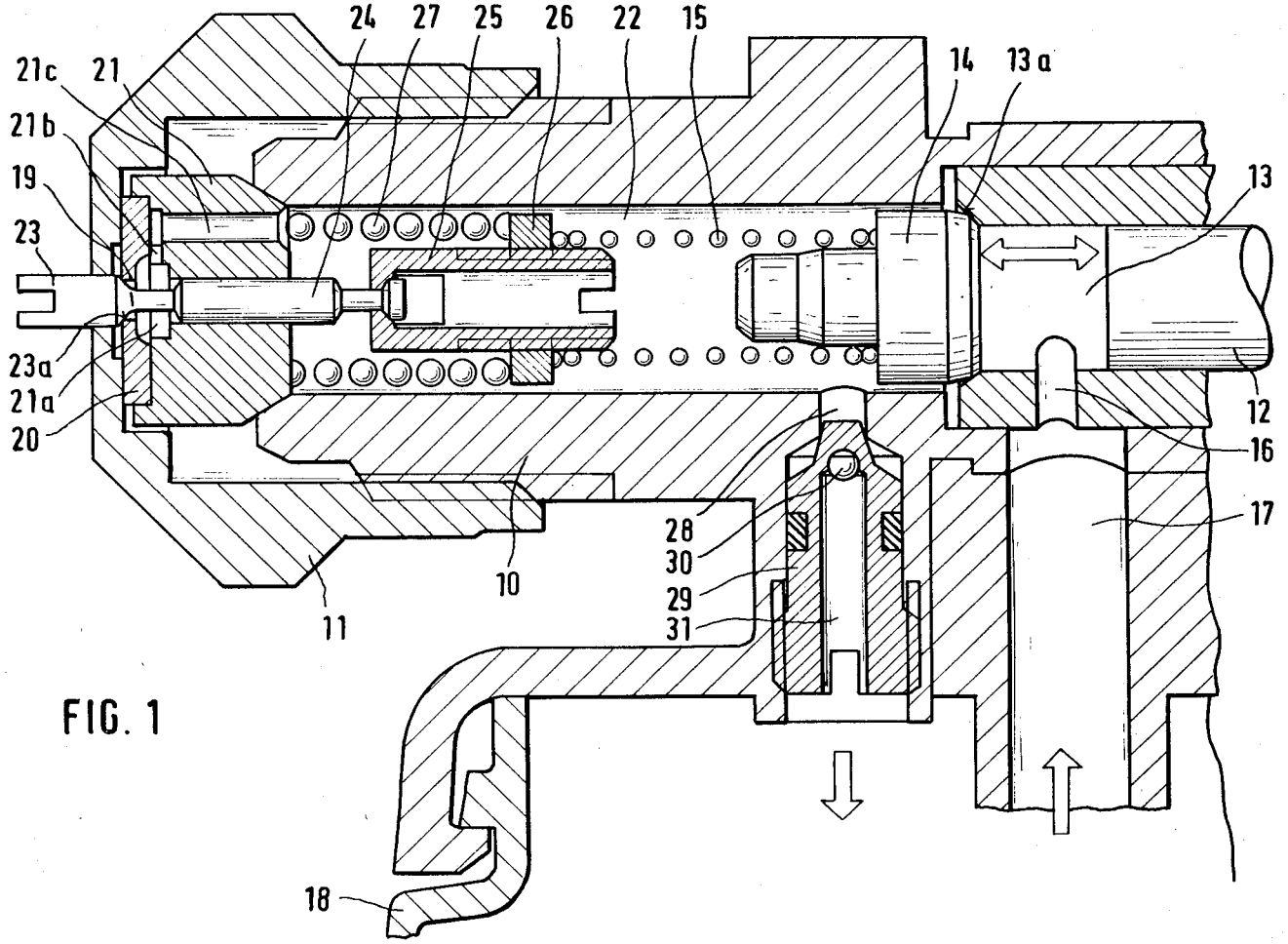
FIG. 1 is a longitudinal section through those parts of a hand-held spray gun which are essential for an explanation of the invention.

FIG. 1 is a longitudinal section through those parts of a paint spray gun which are essential for explaining the invention. This paint spray gun includes a built-in conveying piston pump and an attached paint container and a piston drive (for instance an electrical swinging armature drive), a gun grip comprising the trigger which initializes the piston drive and an electrical lead for the piston drive, which components are not shown herein.

A gun barrel 10 is shown which is covered at its front end, i.e., at its spraying end by a screw cap 11. A conveying pump built into this paint spray gun includes an oscillating piston 12, a pump chamber 13, and a pump discharge valve 14. The piston 12 is reciprocated by a drive (not shown), and this motion is indicated by a double arrow in the drawing. A return stroke spring 15 presses the pump discharge valve 14 against the outlet **13*a* of the pump chamber 13, which outlet 13*a* is shaped as a valve seat. A paint intake slot 16, which can be closed by the piston 12, opens into the pump chamber 13. The slot 16 communicates with the interior of an attached paint reservoir 18 via an intake line 17**.

The delivery of the paint ensues through a nozzle aperture in the form of a circular pattern jet which is molded into a nozzle plate 20. The screw cap 11 holds the nozzle plate 20 against a twist member 21, which is rigidly arranged in the gun barrel 10 and which includes a twist chamber **21*a* located immediately preceding the nozzle 19. The twist chamber 21*a* communicates with the inside of the gun barrel 10 via tangential feed channels 21*b* and via axial feeder bores 21*c* connecting thereto. The inside space of the gun member 10 is an elongated, essentially cylindrical, conveying chamber 22 which connects the pump discharge valve 14 and the spray nozzle 19**.

A second valve is provided in accord with this invention which includes a closing member 23 and a valve stem 24. The closing member 23 includes a closing face **23*a* in the shape of a conic frustum which lies against the outside of the nozzle plate 20, namely against the edge of the nozzle aperture 19, in sealing fashion. The closing member 23 is thereby seated at the one end of the valve stem 24, which penetrates through the nozzle aperture 19 and leads into the conveying chamber 22. The middle portion of this valve stem 24 is guided in a central axial bore of the twist member 21 and its other end is rigidly anchored in a spring cage 25. A pressure adjustment screw 26 is adjustably seated on the spring cage 25, both sides of this screw 26 serve as spring abutment, namely, first, as an abutment for a coil spring 27 supported against the twist member 21, and, second, as an abutment for the weaker return stroke spring 15 of the pump discharge valve 14. The two springs 15 and 27 hold the spring cage 25, and, thus, the valve stem 24 is rigidly connected to the latter in "floating" fashion in the conveying chamber, whereby the design of the springs is such that if the conveying chamber 22 is empty, the stronger spring 27 loads the spring cage 25, such that the conic face 23*a* of the closing member 23 is firmly pressed against the nozzle plate 20**.

A bore 28 discharges into the conveying chamber 22 close to the pump discharge valve 14. This bore 28 is connected to the paint container 18 via a choker valve 29 with cross-bore 30 and return line 31. The arrangement is such that in the position shown in the drawing, there is no connection between the bore 28 and the cross-bore 30, but such that such an adjustable connection is made by screwing the choker valve 29 downwardly.

The paint spray gun operates in the following way. In its idle condition, the gun is in the condition shown in the drawing, i.e., the valves 14, 23, and 24 are closed. For activation, the operator actuates the gun trigger (not shown) with the result that the piston drive (not shown) starts up and reciprocates the piston 12, for example, at twice the motor's frequency. In its first return stroke (suction stroke), the piston 12 opens the intake slot 16 and thereby lowers the pressure in the pump chamber 13 so that paint from the paint reservoir 18 is drawn or suctioned in via the intake line 17. In the following forward stroke (pressure stroke), the paint is placed under pressure after the intake slot 16 has been closed and the pump discharge valve 14 opens against the force of its return stroke spring 15 and paint is pumped into the conveying chamber 22. Upon further forward stroke of the piston 12, the pressure in the conveying chamber 22 rises until—if need be, after a number of pressure strokes—the opening pressure of the second valve 23, 24 is reached in the conveying chamber 22, i.e., the spring cage 25 and valve stem 24 move against the action of the spring 27 (toward the left in the drawing) and the closing member 23 lifts off from the nozzle plate 20. Paint under high pressure thus flows through the axial bores **21*c* and through the tangential bores 21*b* into the twist chamber 21*a* and flows from the latter through the annular gap between the closing member 23 and the edge of the nozzle aperture 19 so as to be finely atomized. At the end of the forward stroke of the piston 12, the pressure in the conveying chamber 22 once again falls below the opening pressure of the second valve 23, 24, with the result that the spring 27 once again closes the second valve 23, 24, i e., the closing member 23 is again pressed against the nozzle plate 20. This operation is repeated with every reciprocating motion of the piston 12 until the piston drive is turned off. The radial or essentially radial surfaces of the valve stem 24 are dimensioned such that, given the hydraulic pressure in the conveying chamber 22, there is a force component onto the valve stem 24 in opening direction of the valve 23, 24. It should also be pointed out that, given an empty conveying chamber 22, a plurality of forward strokes of the piston 12** are required before the opening pressure of the second valve is reached in the conveying chamber, while in contrast if a conveying chamber already filled by the preceding spraying event, the opening pressure can already be reached at the first forward stroke after the piston drive has been turned on again.

A significant advantage of the invention is that the second valve 23, 24 opens only when the prescribed opening pressure is exceeded and immediately closes again when the operating pressure is below the opening pressure. The pressure required for a faultless atomization of the paint is thus always available during the spraying process; atomization is complete at the beginning of the spraying process and at the end thereof; and, thus, known and feared drips at the start and at the end are completely avoided. Furthermore, unintentional co-intake of air by the conveying pump will not lead to a deterioration of the spray pattern. A further significant advantage of the invention is that the delivered quantity can be varied within very broad limits without having to accept a deterioration of the atomization and without risk of a blockage of the nozzle or of the bores of the twist chamber during interruptions in work. The first possibility of varying the quantity of paint conveyed (per time unit) is achieved by the known adjustment of the maximum stroke traversed by the piston. As known, however, only a comparatively slight reduction of the quantity of paint throughput is thereby obtainable because the delivery pressure drops greatly upon reduction of the pump stroke and the risk of overheating the piston drive arises. The second inventive possibility of varying the quantity of paint throughput is by a corresponding adjustment of the force relationship between the two springs 15 and 27 by turning the adjustment screw 26. The further the adjustment screw 26 is turned toward the left in the drawing, the greater the spring 27 is pre-stressed in closing direction of the second valve 23, 24 and the return stroke valve 15 relieved; an increase in the opening pressure of the second valve 23, 24, however, leads to a shortening of the open phases of the closing member 23, and, thus, to a reduction in the quantity of paint sprayed per time unit. Limits are also placed on this reduction of the paint throughput as a result of increasing the opening pressure of the second valve because a feed pressure in the conveying chamber 22 leads to a considerable increase of the flow rate of the paint through the annular gap, and thus opposes the desired reduction in paint throughput and because inhibiting reactions on the pump result. In accord with the invention, therefore, a third further possibility for setting the paint throughput is provided, namely by means of the bore 28 with choker valve 29 which acts as an overflow opening. When the choker valve 29 is (partially) screwed or turned out in the downward direction, a part of the paint located in the conveying chamber 22 can flow back into the reservoir 18, and the paint throughput at the nozzle 19 can be further reduced without the piston 12 having to be greatly restricted in its stroke motion required for good pressure build-up. By means of a suitable coordination of all three said adjustment possibilities, the paint throughput can be varied within very broad limits and the optimum atomization can be guaranteed within this throughput range. Practical tests have shown that the paint throughput can be reduced from, for example, 300 g/min down to about 40 g/min without deteriorating the spray pattern and without too great a limitation of the piston stroke of the pump.

FIGS. 2 and 2A show an embodiment modified somewhat in comparison to the choker valve 29 of FIG. 1, whereby parts identical to parts of FIG. 1 are provided with the same reference characters, namely the conveying chamber 22, the overflow bore 28 and the paint reservoir 18. In contrast to FIG. 1, however, the overflow bore 28 is vertically conducted down into the paint reservoir 18. The overflow quantity can be regulated by a rotary slide valve 40 penetrating the bore 28; this rotary slide valve 40 includes a notch 41, as may be seen best in FIG. 2A. The rotary position of this notch 41 allows an adjustment of the overflow quantity from zero up to a maximum value. The adjustment of the rotary position of the notch 41 is by means of an adjustment knob 42, which is rotatably seated at the outside of a cladding 43 of the pump housing and which can be brought into torsional engagement with the rotary slide valve 40 by being pressed in against the force of a spring 44. The rotary position of the rotary slide valve 40 and, consequently, the paint quantity throughput can be easily adjusted from the outside by turning the adjustment knob 42. Expediently, a scale will be applied to the outside of the cladding 43, for instance, in accord with that in FIG. 2A, in order to thus make it easier for the operator to set the quantity of paint throughput.

Of course, there are numerous possibilities of modifying the two illustrated embodiments of the adjustable overflow bore. Thus, for example, the rotary slide valve of FIG. 2 can also be employed in a cross-bore which penetrates at the bore 28. It is also possible to have the overflow bore 28 depart from the pump chamber 13, namely from a point in close proximity to the discharge valve 14. Finally, the overflow opening can also be a simple, non-adjustable throttle bore, even though the range of paint throughput obtainable is smaller than given the overflow bore with adjustment possibility which has been set forth.

The following FIGS. 3 through 8 show various modifications of the execution and arrangement of the second valve.

Figure 3:
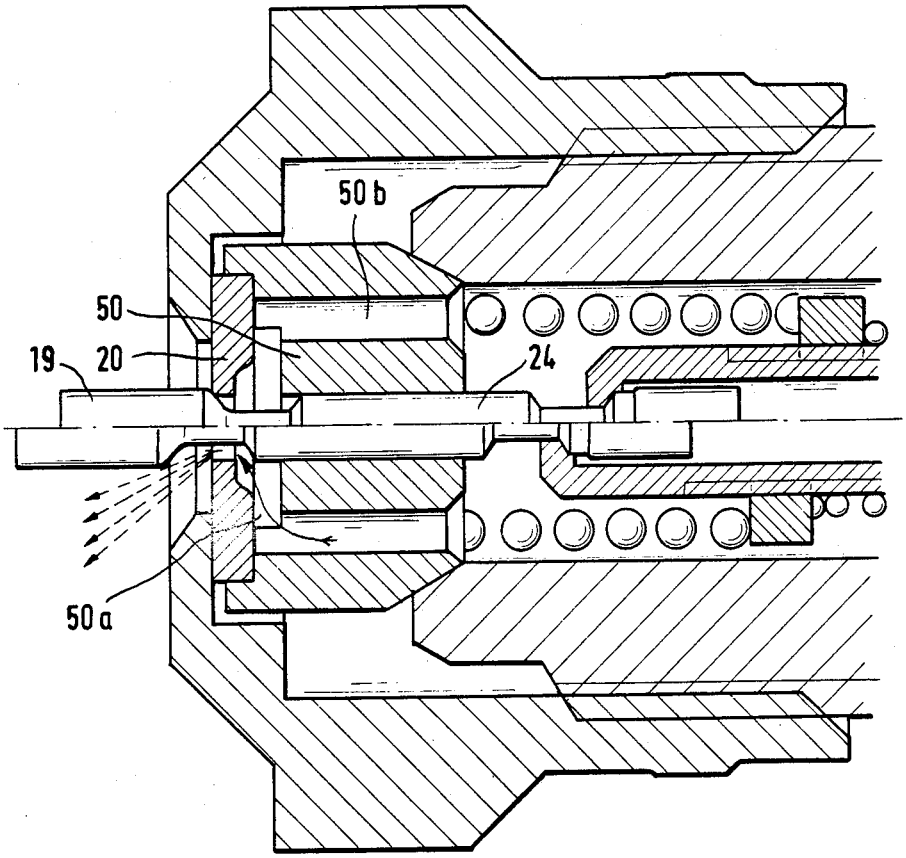
FIGS. 3 through 8 are longitudinal sectional views through the front part of a hand-held spray gun, shown in an enlarged scale, showing various modified embodiments of the second valve.

The embodiment of FIG. 3 differs from that of FIG. 1 only in that the twist member 21 has been replaced by a guide member 50 in which the valve stem 24 slides, this guide member 50 comprising a feed chamber **50*a* and axial bores 50*b* discharging into the chamber 50*a***.

Figure 4:
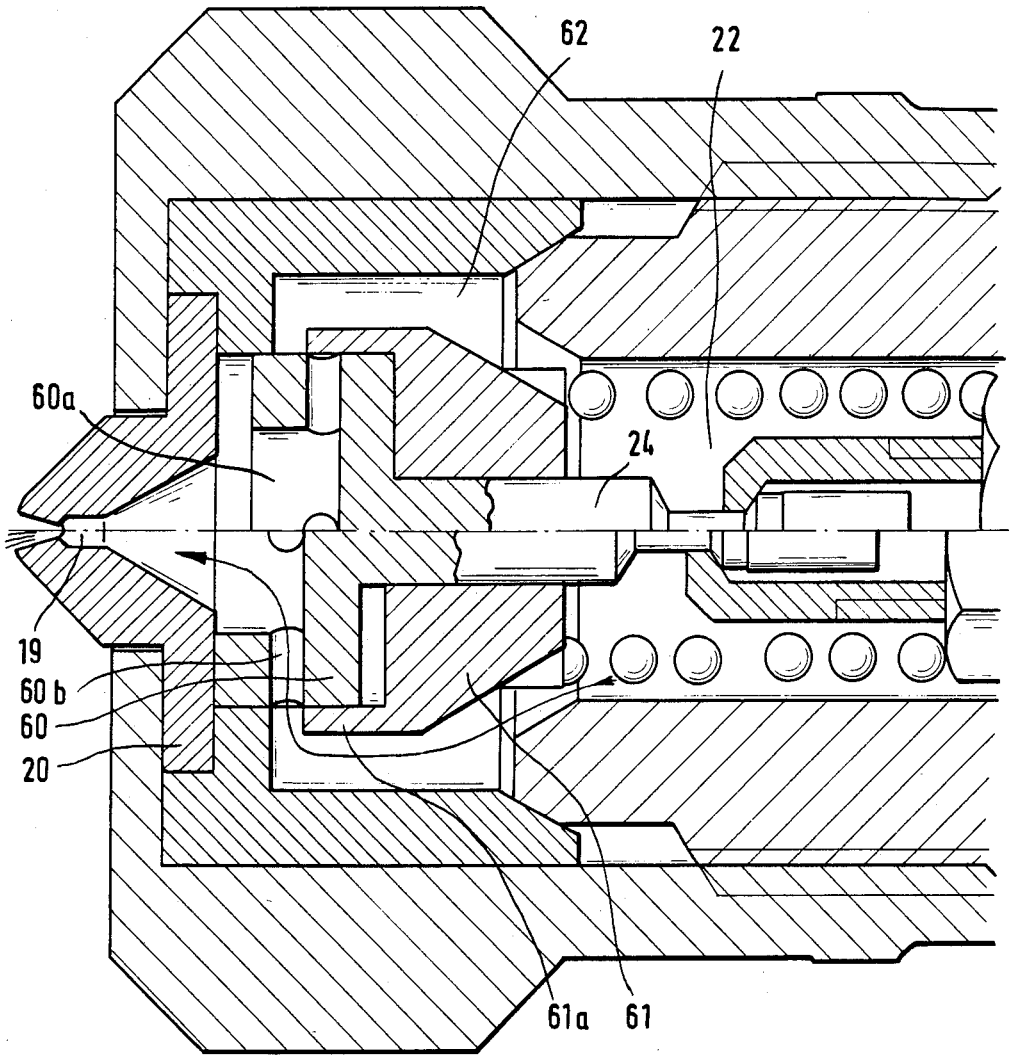

FIG. 4 shows an embodiment which differs from those previously set forth now in that the nozzle 19 is not a circular pattern nozzle but a slotted nozzle (flat-section nozzle) and, in particular, in that the second valve is not an outside valve but an inside valve. What is meant by the term inside valve is that the closing member of the second valve (referenced 60 here) is located inside the conveying chamber 22, namely immediately in front of the nozzle plate 20. The closing member 60 thus has the form of a comparatively thick circular disk-shaped plate attached to the front face of the valve stem 24 and comprising a central recess at its free surface representing a feed chamber as well as comprising feeder channels **60*b* leading radially from the edge of the plate to the feed chamber 60*a*. The front region of the valve stem 24 and the closing member plate 60 are guided in sliding fashion in a guide member 61 which comprises a projecting annular edge 61*a* and is secured to the gun barrel 10. In closed position of the second valve 24, 60, i.e., in retracted position, the annular edge 61*a* of the guide member 61 covers the radial bores 60*b* of the closing member 60, so that the paint situated in the conveying chamber 22 can in fact fill the space 62 between the guide member 61 and the walls of the gun barrel 10 but cannot proceed to the feed chamber 60*a* and, thus, to the nozzle aperture 19. In open position of the second valve 26, 40, i.e., in the advanced position, the closing member 60 lies against the back side of the nozzle plate 20 and its radial channels 60*b* project beyond the annular edge 61*a* of the guide member 60, so that the paint situated in the space 62 can flow through the radial channels 60*b* into the feed chamber 60*a* and to the nozzle aperture 19**.

Figure 5:
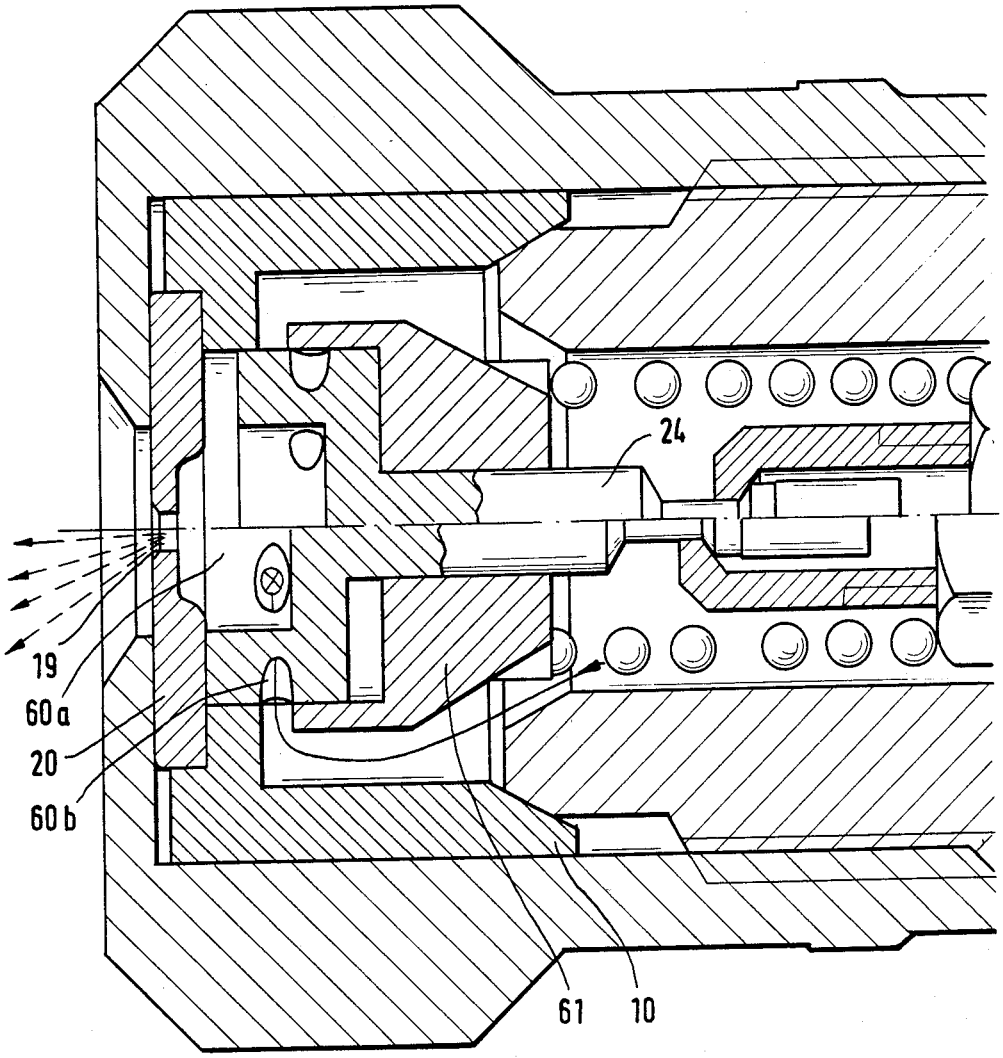

FIG. 5 shows an embodiment of the invention which essentially corresponds to that of FIG. 4, but applied to a circular pattern nozzle. Over and above this, the feed chamber **60*a* of the closing member 60 is fashioned as a twist chamber, i.e., the feed channels 60*b* discharging radially into the chamber 60*a* in the exemplary embodiment of FIG. 4 are fashioned herein as channels which tangentially discharge into the chamber 60*a*. The functioning of the valve 24, 60 of FIG. 5 corresponds to that of the valve of FIG. 4**.

Figure 6:
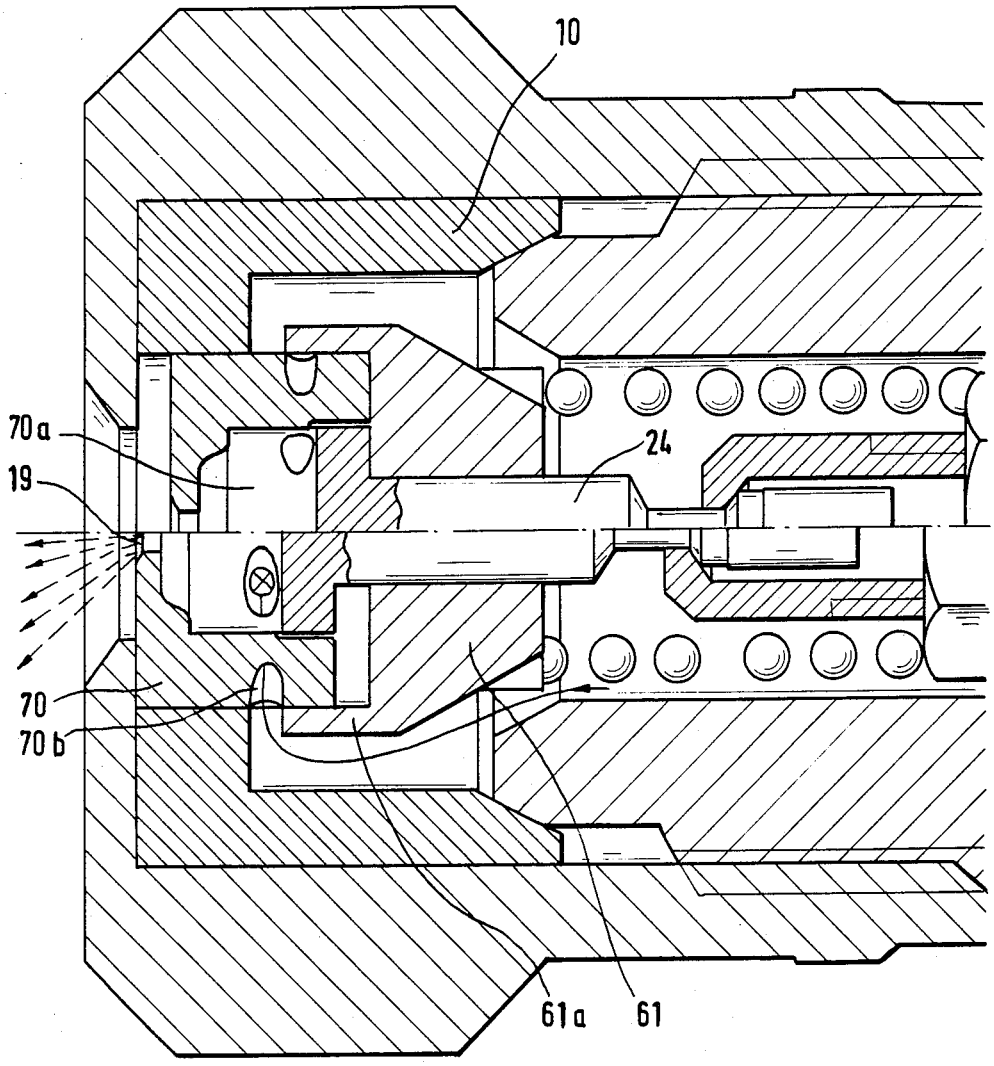

FIG. 6 shows an embodiment that differs from that of FIG. 5 essentially in that the closing member of the second valve is unitary with the nozzle plate to form a one-piece component part 70 which represents a hollow member comprising a central, inside feed chamber **70*a*, whereby feed channels 70*b* tangentially discharge into the feed chamber 70*a*. The opening and closing operation corresponds entirely to that of the embodiment of FIG. 5, i.e., the feed channels 70*b* are covered by the annular edge 61*a* of the guide member 61 in the retracted valve position, in contrast whereto these channels 70*b* are free in the advanced valve position. In contrast to all of the other exemplary embodiments shown here, this joining of the closing member and of the nozzle plate means, however, that the nozzle plate is movable, i e., is seated in the muzzle of the gun barrel 10** in slidable fashion.

Figure 7:
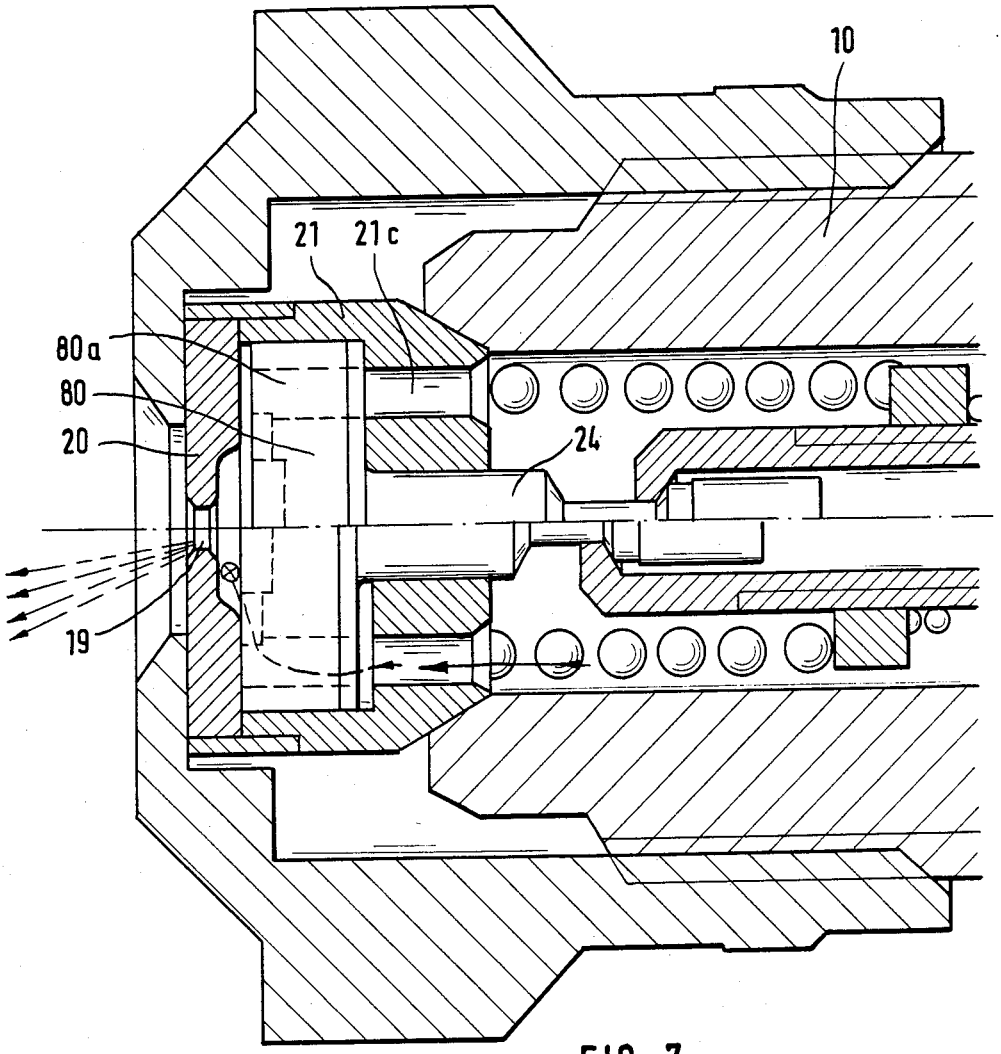

FIG. 7 shows an embodiment comprising an inside valve, whereby the guide member 21 having feed channels **21*c* and penerated in sliding fashion by the valve stem 24 comprises a large central opening in which a twist member 80 is accommodated in sliding fashion. The twist member 80, which simultaneously acts as closing member, comprises feed channels 80*a* and is seated at the end of the valve stem 24, i.e., is displaceable in common with the latter. What is essential in this embodiment then is that the channels 21*c* of the guide member 21 and the valve channels 80*a* of the twist member 80 are offset relative to one another. When, for example, respectively three channels 21*c*, 80*a* offset by 120° are present in the guide member 21 and in the twist member 80, then the offset of the channels 80*a* relative to the channels 21*c* respectively amounts to 60°. In the retracted position of the valve stem 24, the back side of the twist member 80 lies against the inside ground area of the guide member 21 in sealing fashion, and there is no connection existing between the channels 21*c* and 80*a*. When, by contrast, the twist member 80 is lifted off from the guide member 21*c* by the valve stem 24, then fluid can flow through the resulting gap from the channels 21*c* to the channels 80*a* and can flow farther to the twist chamber and to the nozzle aperture 19**. The valve is thus closed or, respectively opened in this way.

Figure 8:
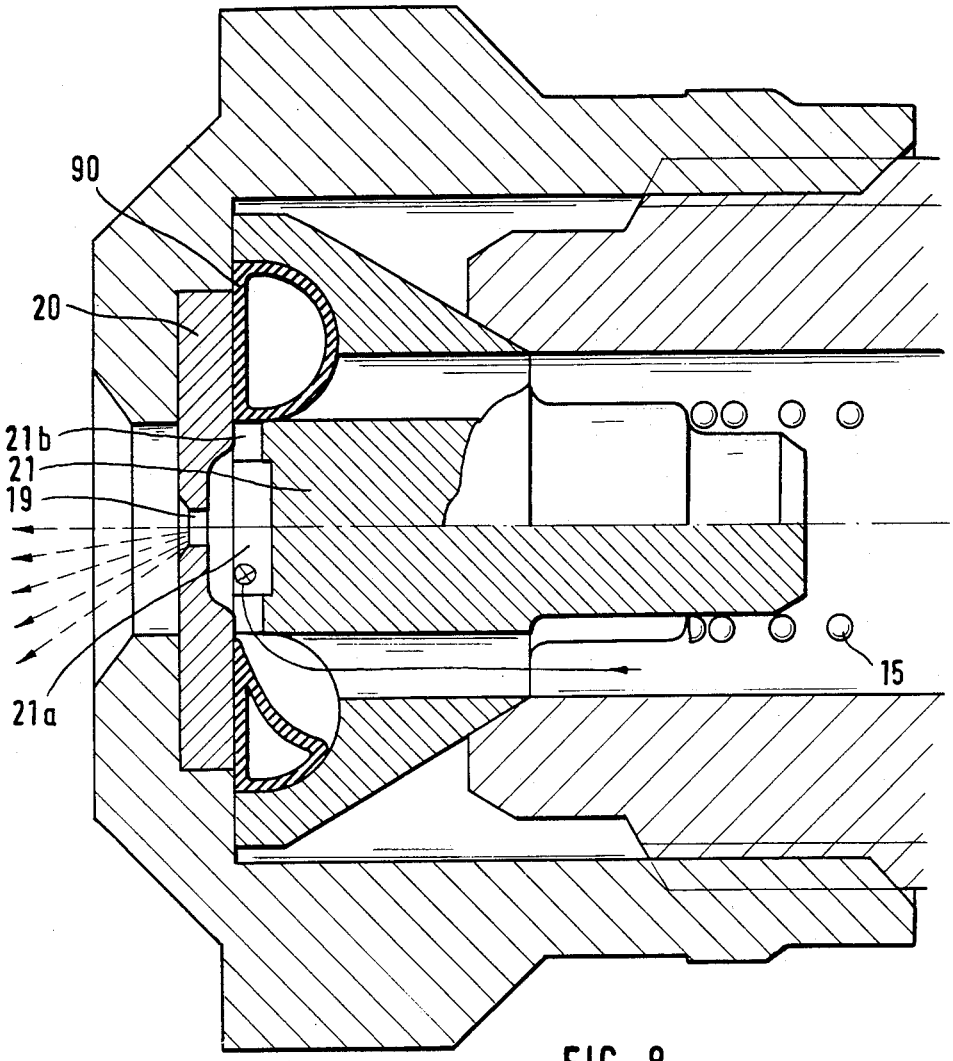

FIG. 8 shows an embodiment comprising an inside valve wherein the valve differs substantially from the valve arrangements set forth up to now. The second valve herein, includes an elastic sealing ring 90 applied to the nozzle plate 20, the purpose of this elastic sealing ring 90 is to close or to release the tangential feed channels **21*b* of the twist member 21. To this end, the elasticity of the sealing ring 90 is dimensioned such that it retains its shape up to a defined pressure, namely the opening pressure of the valve, and thereby covers the channels 21*b* but then, when the pressure in the conveying chamber 22 rises above the opening pressure, is indented or shaped such that the channels 21*b* are released; the closed and open shapes of the sealing ring 90** are indicated in the drawing.

Of course, the illustrated exemplary embodiments of the fashioning of the second valve can be subject to numerous modifications in spray guns. Thus, the embodiments shown with circular pattern nozzle and comprising an inside valve can also be employed for flat-section nozzles and, over and above this, possibilities of interchange between embodiments comprising twist members and lacking twist members are also possible.

Figure 9:
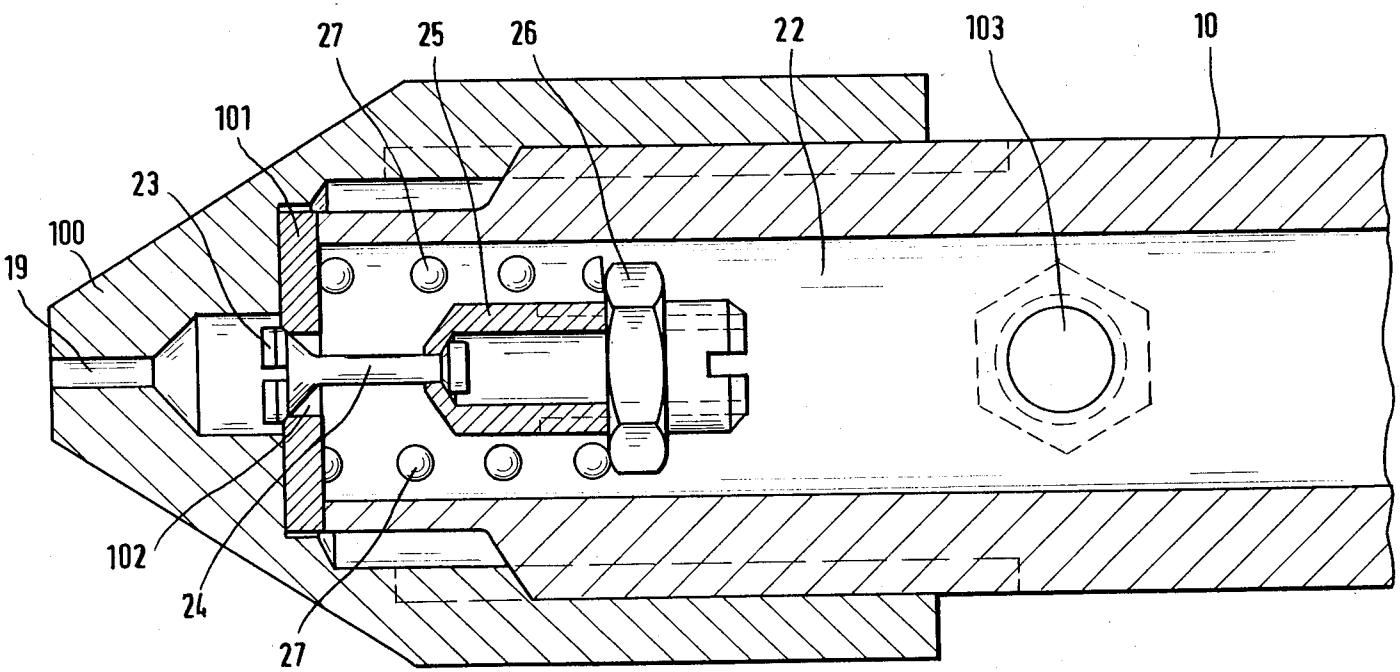
FIG. 9 is a longitudinal sectional view of parts of a paste-delivering apparatus.

FIG. 9 shows an embodiment of the invention as applied to a delivery device for pasty compounds, i.e., to a device wherein no atomization of the delivered medium. A screw cap 100 which simultaneously represents a nozzle plate for the delivery nozzle 19 is screwed onto the gun barrel 10 in this embodiment. A valve plate 101 which is retained by the screw cap 100 lies on the front edge of the gun barrel 10. The valve plate comprises a central valve opening 102. A second valve is accommodated in the conveying chamber 22, the structure of this second valve corresponds to that of the spray gun of FIG. 1; the second valve includes a closing member 23 lying against the valve plate 101 from the outside of a valve stem 24, a spring cage 25 comprising adjustment nut 26, and a valve spring 27. The manner of functioning of the valve may be understood from the preceding explanations, i.e., when a defined value of pressure is reached in the conveying chamber 22, the unit composed of the spring cage 25, valve stem 24 and closing member 23 is displaced toward the left against the force of the spring 27 so that the closing member 23 lifts off from the valve plate 101 and releases a circular passage for the pasty compound to the delivery aperture 19. When the pressure in the conveying chamber once again falls below the value of the opening pressure, then the valve is immediately closed by the spring 27.

In contrast to FIG. 1, the pump chamber and the discharge valve thereof are not shown in FIG. 9 because it is presumed in this exemplary embodiment of FIG. 9 that the conveying pump is not directly built into the delivery gun but is situated at a distance therefrom, whereby the pump outlet and the conveying chamber 22 are then, for example, connected to one another by a hose conduit. The overflow or, respectively, throttle opening can thereby be provided in or at the conveying pump whereby this mechanism is, however, of somewhat less significance given pasty compounds than given liquids because pasty compounds have a certain inherent compressibility. In automatic systems, the operating condition of the nozzle (open or closed) can be reliably monitored with little difficulty by monitoring the material pressure in the conveying chamber 22 with a pressure sensor 103. Moreover, the conveying pump can, of course, also be directly built into the delivery gun given a device of FIG. 9, just as the exemplary embodiments of FIGS. 1–8 can also be employed in conveying pumps wherein the delivery gun is arranged at a distance.

It can be stated in summary that the essence of the invention is comprised therein that a second valve is arranged at or in the region of the delivery nozzle in addition to the discharge valve of an oscillating conveying pump, this second valve being actuatable by the pressure prevailing in the space between the pump discharge valve and said second valve, whereby the opening pressure of the second valve is greater than that of the pump discharge valve. How high the opening pressure of the second valve lies above that of the pump discharge valve thereby depends on a number of factors of the respective applications depending, among other things, on the desired quantity delivered per time unit; it can be stated, however, that the opening pressure of the second valve should be at lest twice as high as the opening pressure of the pump discharge valve.

Although the invention has been described with respect to preferred embodiments, it is not to be so limited as changes and modifications can be made which are within the full intended scope of the invention as defined by the appended claims.

We claim as our invention:

1. An apparatus for the quantitatively definite delivery of a liquid or thick, pressurized medium including an electrically driven conveying pump having means defining a pump chamber connected via an intake line to a medium reservoir and a discharge valve actuatable by the pressure prevailing in the pump chamber, further including means defining an elongated, esentially cylindrical conveying chamber having an end proximal to the pump and operatively associated with the pump discharge valve and a delivery nozzle situated at the end of the conveying chamber distal from the pump, characterized by a second valve (23, 24, 25, 27, 90) associated with the conveying chamber (22) and having a closing member (23, 90) arranged adjacent the delivery nozzle (19) and actuatable by the pressure in the conveying chamber (22), whereby the opening pressure of the second valve is greater than that of the pump discharge valve (14), and wherein said apparatus is shaped as a hand-held spray gun comprising an electrically driven piston pump associated with the gun casing and comprising a delivery nozzle shaped as a spray nozzle, further characterized by throttle means communicating with the conveying chamber (22), said throttle means being in communication with the medium reservoir (15) via a return line (31) during operation of the pump for cooperating in controlling the quantity of liquid or medium delivered from said conveying chamber to said nozzle during operation of the pump.

2. An apparatus according to claim 1, characterized in that the throttle means comprises a channel departing from the conveying chamber (22), and an adjustable throttle member (29, 40) being seated in said channel.

3. An apparatus according to claim 2, characterized in that the throttle member is a rotary slide valve (40) which is actuatable from the outside of the gun casing.

* * * * *